US008096767B1

(12) United States Patent
Liang

(10) Patent No.: US 8,096,767 B1
(45) Date of Patent: Jan. 17, 2012

(54) TURBINE BLADE WITH SERPENTINE COOLING CIRCUIT FORMED WITHIN THE TIP SHROUD

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 498 days.

(21) Appl. No.: 12/365,342

(22) Filed: Feb. 4, 2009

(51) Int. Cl.
*F01D 5/18* (2006.01)

(52) U.S. Cl. ..... 416/97 R; 416/91; 416/191; 415/115

(58) Field of Classification Search ..... 416/97 R, 416/91, 191; 415/115
See application file for complete search history.

(56) References Cited

U.S. PATENT DOCUMENTS

| | | | | |
|---|---|---|---|---|
| 3,628,880 | A * | 12/1971 | Smuland et al. | 415/175 |
| 5,320,485 | A * | 6/1994 | Bourguignon et al. | 415/115 |
| 5,350,277 | A | 9/1994 | Jacala et al. | |
| 5,482,435 | A * | 1/1996 | Dorris et al. | 416/97 R |
| 6,254,333 | B1 * | 7/2001 | Merry | 415/115 |
| 6,471,480 | B1 * | 10/2002 | Balkcum et al. | 416/97 R |
| 7,147,439 | B2 * | 12/2006 | Jacala et al. | 416/97 R |
| 7,427,188 | B2 | 9/2008 | Neuhoff et al. | |
| 7,568,882 | B2 * | 8/2009 | Brittingham et al. | 415/1 |
| 7,686,581 | B2 * | 3/2010 | Brittingham et al. | 416/97 R |
| 2006/0042084 | A1 * | 3/2006 | Hudson et al. | 29/889.72 |
| 2010/0239432 | A1 * | 9/2010 | Liang | 416/97 R |

FOREIGN PATENT DOCUMENTS

EP 1 865 149 A2 * 12/2007

* cited by examiner

*Primary Examiner* — Anh Mai
(74) *Attorney, Agent, or Firm* — John Ryznic

(57) ABSTRACT

A turbine rotor blade with a tip shroud that has a baffle seal with a knife edge to form a seal with a honeycomb seal of the shroud, where the tip shroud includes larger ribs that form separate compartment each with smaller ribs that form serpentine flow cooling circuits within the compartment to provide cooling for the tip shroud. Two hard faces each include an impingement cavity connected to one of the serpentine to provide impingement cooling to the backside wall of the hard face surface. The tip shroud periphery includes film cooling holes to discharge the spent cooling air from the serpentine circuits out from the tip periphery. A row of baffle seal cooling holes connect the serpentine circuit to the pressure side of the knife edge to provide cooling for the baffle seal.

10 Claims, 2 Drawing Sheets

TURBINE BLADE WITH SERPENTINE COOLING CIRCUIT FORMED WITHIN THE TIP SHROUD

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade with tip shroud cooling.

2. Description of the Related Art Including Information Disclosed Under 37 CFR 1.97 and 1.98

In a gas turbine engine, especially an industrial gas turbine engine, a turbine section includes a plurality of rotor blades with stator vanes to direct a hot gas flow through the turbine stages and extract mechanical energy from the hot gas flow. The efficiency of the engine can be increased by passing a higher gas flow into the turbine. However, the factor limiting the highest temperature usable in the turbine is the material properties and the internal cooling ability of the first stage of the turbine. However, the second stage and even the third stage turbine blades and stator vanes can be supplied with cooling air to provide cooling for these airfoils in order to increase the useful life of the parts. Although the cooling requirements of later stage turbine airfoils can usually be easily met, the turbine efficiency can be decreased by using more cooling air than is required. Also, some parts of the turbine airfoils such as the rotor blade tips require cooling at the hot spots. Allowing for excessive hot spots to exist on the airfoils can lead to premature damage or unnecessary creep life damage.

Another method of increasing the efficiency of a turbine is to reduce the leakage that occurs across gaps such as the blade tip gap formed between the rotor blade and the stationary stator casing. Rotor blades make use of an outer shroud member on the radial outer end of the blade. The blade shrouds include abutment faces in which adjacent shrouds form an enclosed flow path for the hot gas flow to pass through the blade stage. The blade shrouds include hard material coatings on the abutting shroud surfaces to increase the useful life of the blades. Leakage across the shroud contact faces will lower the turbine efficiency as well as allow for the high temperature gas flow to affect the hard coatings on the contact faces, leading to creep extension and burning of the coatings and therefore large gaps.

In an industrial gas turbine (IGT) engine (the engine used for electric power generation), the latter stage rotor blades ($3^{rd}$ and $4^{th}$ stage) are long blades and include shrouds at the blade tips to function as snubbers that dampen vibration found in these larger length blades. The shrouds also form surfaces for the hot gas flow through the turbine stage. With higher temperature turbine inlet temperatures for advanced engines, more cooling capability is required for these blade shrouds. U.S. Pat. No. 5,350,277 issued to Jacal et al on Sep. 27, 1994 and entitled CLOSED-CIRCUIT STEAM-COOLED BUCKET WITH INTEGRALLY COOLED SHROUD FOR GAS TURBINES AND METHODS OF STEAM-COOLING THE BUCKETS AND SHROUDS which discloses a large rotor blade for an IGT with a tip shroud and a knife edge seal that is used to form a hot gas flow seal with an outer shroud of the engine. the tip shroud includes surfaces on both sides that rub against adjacent tip shrouds to dissipate vibrations through friction.

One prior art references attempts to address this problem. U.S. Pat. No. 6,471,480 B1 issued to Balkeum, III et al Oct. 29, 2002 and entitled THIN WALLED COOLED HOLLOW TIP SHROUD discloses a rotor blade tip shroud having cooling air supply passages, metering holes and a plurality of shroud core section to provide cooling for the tip shroud. Cooling holes in the base of the shroud core section also provides cooling air to the tip shroud. Cooling holes are also positioned on the outer walls of the tip shroud core sections to discharge cooling air out from the tip shroud and at the contact surface of the tip shrouds.

U.S. Pat. No. 7,427,188 B2 issued to Neuhoff et al on Sep. 23, 2008 and entitled TURBOMACHINE BLADE WITH FLUIDLY COOLED SHROUD shows another blade tip shroud with cooling. In this tip shroud cooling design, the same cooling air pressure is used throughout the entire tip shroud cooling circuit. Therefore, the various sections of the tip shroud cannot be selectively cooled by passing less or more cooling air to the portions that require less cooling or more cooling.

Another prior art reference provides cooling for the hard contact face of the tip shrouds. U.S. Pat. No. 4,948,338 issued to Wickerson on Aug. 14, 1990 and entitled TURBINE BLADE WITH COOLED SHROUD ABUTMENT SURFACE discloses a tip shroud with a hard face coating being cooled by a wide slot cooling duct. Cooling air through the duct is discharge from the shroud through three ports that are angled downward so that the exhausted cooling air flows over part of the exterior of the coating and also over the part of the exterior of the abutting coating on the adjacent shroud member to provide film cooling for both coatings.

What the two above prior art tip shroud cooling patents do not disclose is the use of impingement cooling for the hard coating on the contact faces of the tip shrouds, or the use of pin fins in the tip shroud cavities or compartments to enhance heat transfer coefficient for improving the cooling of the contact faces and the tip shroud while using less cooling air.

BRIEF SUMMARY OF THE INVENTION

It is an object of the present invention to provide for a large IGT turbine rotor blade with tip shroud cooling.

It is another object of the present invention to provide for a large IGT turbine rotor blade with tip shroud cooling that can be provides higher cooling to hotter surfaces of the shroud.

It is another object of the present invention to provide for a large IGT turbine rotor blade with a thicker tip shroud that provides higher strength and at a lighter weight than a solid tip shroud.

The above objectives and more are achieved with the turbine blade having a shroud tip with a number of separate serpentine flow cooling circuits to provide various levels of cooling to specific portions of the tip shroud. The serpentine flow cooling passages each have chevron trip strips to promote heat transfer, and each are sized and shaped for certain levels of cooling air flow and pressure so that the hottest sections of the tip shroud will be cooled more and thus minimizing the amount of cooling air used while providing high levels of cooling.

Another feature of the invention is the use of ribs that form the serpentine flow passages allow for a thicker tip shroud without increasing the weight. The ribs form rigid structural support members that extend between the inner wall and the outer wall that form the tip shroud. The total tip shroud height can thus be increased from that of a solid tip shroud without adding any additional weight.

Another feature is that the thicker tip shroud also provides for wider damping surfaces for the adjacent tip shroud to dissipate the vibrations.

Another feature is that the thicker tip shroud is to allow for a large fillet can be used for the tip shroud over the prior art tip shrouds.

Another feature is that the thicker tip shroud increases the sectional bending stiffness and thus provides for a more rigid tip shroud.

DETAILED DESCRIPTION OF THE INVENTION

Figure 1:
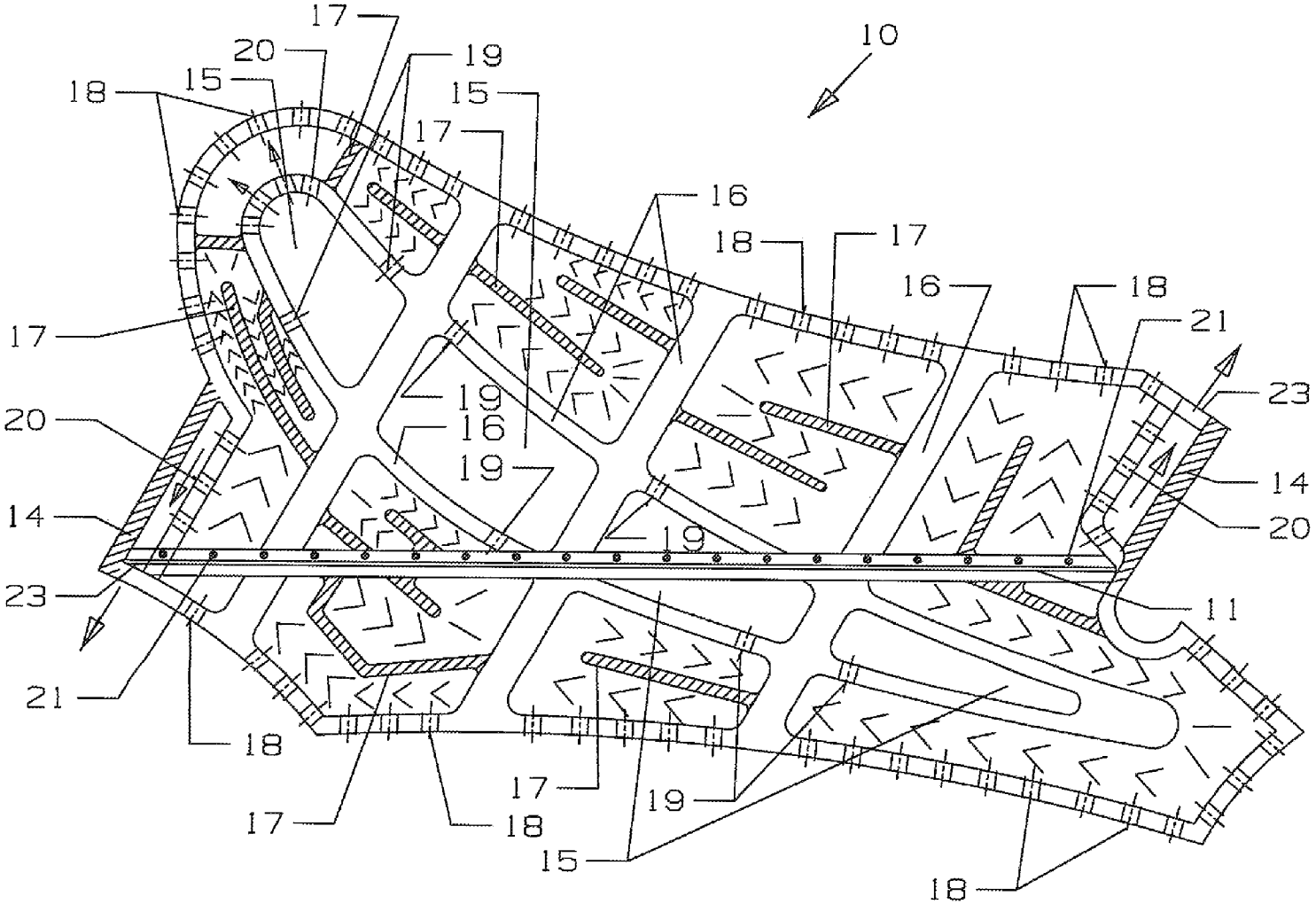
FIG. 1 shows a cross section view from the top of the tip shroud with multiple serpentine flow cooling circuits of the present invention.
Figure 2:
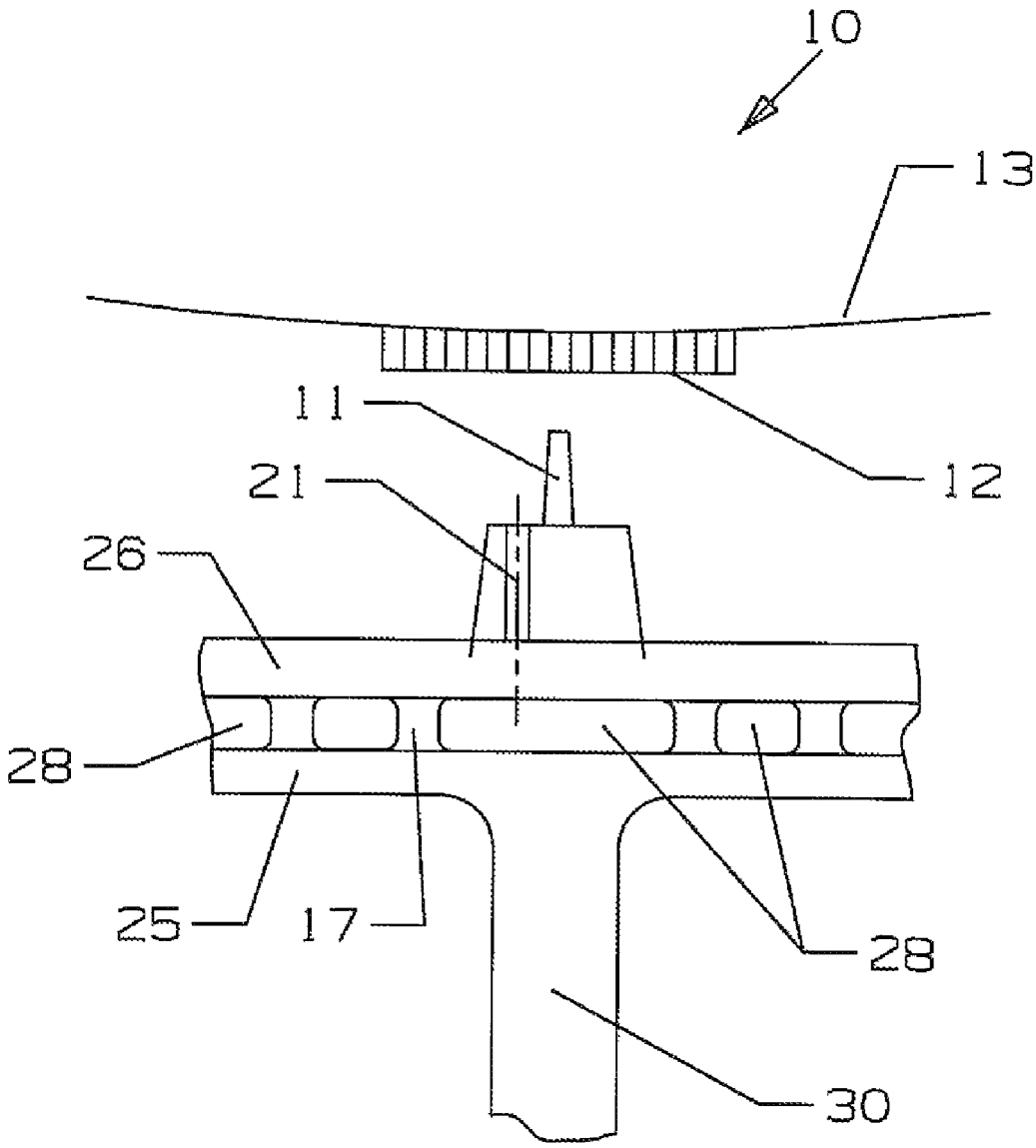
FIG. 2 shows a cross section view from the side of the tip shroud cooling circuit of FIG. 2.

A turbine rotor blade for an industrial gas turbine engine, especially for the larger turbine blades that are used in the last stages of the turbine, where a tip shroud is used to dampen vibrations and form a seal with a knife edge against the inner surface of an outer shroud in the casing. FIG. 1 shows a cross section of the tip shroud 10 with multiple serpentine flow cooling circuits. The tip shroud includes a baffle seal with a knife edge seal 11 that forms a seal with a shroud of the casing as seen in FIG. 2. In this embodiment, the shroud 12 is a honeycomb surface. The tip shroud 10 includes two hard faces 14 that form abutment surfaces with adjacent tip shrouds that also have hard faces. The blade and the tip shroud form cooling air supply channels 15 that deliver pressurized cooling air used to cool the blade and tip. In this embodiment, the tip shroud includes four cooling supply channels, but other embodiments can include less or more than four.

The tip shroud 10 includes main ribs 16 that form structural support members for the tip shroud, and minor ribs 17 that form the serpentine flow passages or circuits between the major ribs 16. The major ribs 16 separate the cooling supply channels 15 and the separate serpentine flow circuits, while the minor ribs 17 form the serpentine flow paths for each circuit. An outer side or periphery of the tip shroud includes film cooling holes 18 that discharge cooling air from the serpentine circuits to the peripheral surface of the tip shroud. Cooling air feed holes 19 deliver the cooling air from the supply channels 15 to the separate serpentine flow circuits. Impingement cooling holes 20 are used at the ends of the serpentine flow circuits to provide impingement cooling to the leading edge of the tip shroud and the backside surface of the hard faces 14. The impingement holes 20 discharge the cooling air into an impingement chamber to impinge onto the backside surface and then discharge the spent impingement cooling air out through cooling air exit holes 23 that open onto the tip shroud periphery. The serpentine flow circuits are lined with chevron trip strips on both upper and lower surfaces to promote heat transfer from the hot metal to the colder cooling air.

As seen in both figures, the baffle seal includes a row of radial cooling holes that connect an inner cooling air passage to a top outer surface of the baffle seal as seen in FIG. 2. The radial cooling holes extend the length of the baffle seal as seen in FIG. 1.

As seen in FIG. 2, the tip shroud is formed by an inner wall or surface 25 and an outer wall or surface 26 with minor ribs 27 extending between the walls. Cooling air cavities 28 are formed between the two walls. The airfoil 30 is shown supporting the tip shroud 10.

Cooling air is supplied from the blade radial cooling channels 15 attached at the blade tip shroud. In order to achieve a better cooling design, the blade tip shroud is formed of several separate compartments in several zones for tailoring the hot gas side pressure distribution around the blade tip shroud. Cooling air is fed into each individual compartment formed within the tip shroud at a designed cooling air pressure and flow rate. Cooling air is then channeled through the serpentine flow circuits with the trip strips to provide the cooling for the tip shroud. The spent cooling air is then impingement onto the backside surface of the two hard faces, or discharged out through film holes located along the leading edge. The spent impingement cooling air from the hard face backside is discharged out the two exit holes. For the baffle seal knife edge cooling, a row of cooling air holes is drilled through the baffle extension support in front of the knife edge to channel the cooling air from the compartments below and out through the baffle. The cooling air jet will flow to provide a film layer next to the knife edge for cooling.

Other structural features are achieved with the use of the tip shroud cooling circuits of the present invention. A higher resistance due to curling stress is achieved for the cooled tip shroud. A thicker tip shroud provides a higher strength at a lighter weight than would a solid tip shroud. A larger fillet can be incorporated into the tip shroud without increasing the overall weight for the shrouded blade design. Ribs forming the cooling compartments also function as bearing structural members. The total rib height is at the same height if the tip shroud was formed as a solid instead of being hollow. Since the hard face is actively cooled by the impingement cooling air, the material used for the tip shroud hard face can be tailored and optimized for a specific hard face material wear and extrusion properties.

I claim the following:

1. A turbine rotor blade comprising:

an airfoil extending from a platform;

the airfoil having a leading edge and a trailing edge, and a pressure side wall and a suction side wall extending between the leading and trailing edges;

a tip shroud having a first hard face to form an abutment surface for a first adjacent blade tip shroud;

a leading edge region cooling air supply channel formed within the tip shroud;

a leading edge region impingement cooling cavity formed within the tip shroud and connected to the leading edge region cooling air supply channel through a plurality of metering and impingement holes; and, a plurality of film cooling holes connected to the leading edge region impingement cooling cavity.

2. A turbine rotor blade comprising:

an airfoil extending from a platform;

the airfoil having a leading edge and a trailing edge, and a pressure side wall and a suction side wall extending between the leading and trailing edges;

a tip shroud having a hard face to form an abutment surface for a first adjacent blade tip shroud;

a leading edge region cooling air supply channel formed within the tip shroud;

a suction side leading edge region serpentine flow cooling circuit formed within the tip shroud and connected to the leading edge region cooling air supply channel through a cooling air feed hole;

a hard face impingement cavity formed behind the hard face and connected to the suction side leading edge region serpentine flow cooling circuit through a row of metering and impingement cooling holes; and, a cooling air exit hole connected to the hard face impingement cavity to discharge impingement cooling air from the hard face impingement cavity.

3. The turbine rotor blade of claim 2, and further comprising:

the hard face is without any cooling air holes.

4. A turbine rotor blade comprising:

an airfoil extending from a platform;

the airfoil having a leading edge and a trailing edge, and a pressure side wall and a suction side wall extending between the leading and trailing edges;

a tip shroud having a hard face to form an abutment surface for a first adjacent blade tip shroud;

a trailing edge region cooling air supply channel formed within the tip shroud;

a trailing edge region serpentine flow cooling circuit formed within the tip shroud and connected to the trailing edge region cooling air supply channel through a cooling air feed hole;

the trailing edge region serpentine flow cooling circuit extending from the suction side of the tip shroud to the pressure side of the tip shroud;

a hard face impingement cavity formed behind the hard face and connected to the trailing edge region serpentine flow cooling circuit through a row of metering and impingement cooling holes; and, a cooling air exit hole connected to the hard face impingement cavity to discharge impingement cooling air from the hard face impingement cavity.

5. The turbine rotor blade of claim 4, and further comprising:

the hard face is without any cooling air holes.

6. A turbine rotor blade comprising:

an airfoil extending from a platform;

the airfoil having a leading edge and a trailing edge, and a pressure side wall and a suction side wall extending between the leading and trailing edges;

a tip shroud having a first hard face to form an abutment surface for a first adjacent blade tip shroud;

a plurality of major ribs formed within the tip shroud that extend from a suction side to a pressure side of the tip shroud;

the plurality of major ribs separate a plurality of serpentine flow cooling circuits formed within the tip shroud in a leading edge region and a trailing edge region and a mid-chord region of the tip shroud;

a first hard face formed in a leading edge region of the tip shroud and connected to the leading edge region serpentine flow cooling circuit;

a second hard face formed in a trailing edge region of the tip shroud and connected to the trailing edge region serpentine flow cooling circuit;

a first hard face impingement cavity formed behind the first hard face and connected to the leading edge region serpentine flow cooling circuit through a first row of metering and impingement cooling holes;

a second hard face impingement cavity formed behind the second hard face and connected to the trailing edge region serpentine flow cooling circuit through a second row of metering and impingement cooling holes;

a first cooling air exit hole connected to the first hard face impingement cavity to discharge impingement cooling air from the first hard face impingement cavity; and, a second cooling air exit hole connected to the second hard face impingement cavity to discharge impingement cooling air from the second hard face impingement cavity.

7. The turbine rotor blade of claim 6, and further comprising:

the first and second hard faces are without any cooling air holes.

8. The turbine rotor blade of claim 6, and further comprising:

the plurality of serpentine flow cooling circuits are separated serpentine flow circuits and is connected to film cooling holes that extend around the entire periphery of the tip shroud except for the first and second hard faces.

9. The turbine rotor blade of claim 6, and further comprising:

a baffle seal with a knife edge extending from the tip shroud; and, a row of baffle seal cooling holes extending along a pressure side of the knife edge from a leading edge to a trailing edge and connected to the serpentine flow cooling circuits to discharge cooling air onto the pressure side of the knife edge.

10. The turbine rotor blade of claim 6, and further comprising:

the plurality of serpentine flow cooling circuits are formed by minor ribs that are thinner than the major ribs.

* * * * *